US011363702B2

(12) United States Patent
Kittleman et al.

(10) Patent No.: US 11,363,702 B2
(45) **Date of Patent: *Jun. 14, 2022**

(54) LIGHT SYSTEM

(71) Applicant: Chromo Lighting, LLC, Santa Ana, CA (US)

(72) Inventors: Robert Kittleman, Santa Ana, CA (US); Sam Goljahi, Long Beach, CA (US); Stephen Harper, Northridge, CA (US)

(73) Assignee: CHROMO LIGHTING, LLC, Santa Ana, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/235,710

(22) Filed: Apr. 20, 2021

(65) Prior Publication Data

US 2021/0243871 A1 Aug. 5, 2021

Related U.S. Application Data

(63) Continuation of application No. 16/805,324, filed on Feb. 28, 2020, now Pat. No. 11,013,092.

(Continued)

(51) Int. Cl.
*H05B 47/10* (2020.01)
*H05B 47/175* (2020.01)

(Continued)

(52) U.S. Cl.
CPC ..... *H05B 47/175* (2020.01); *F21V 33/006* (2013.01); *H05B 47/155* (2020.01); *F21W 2131/407* (2013.01)

(58) Field of Classification Search
CPC .... H05B 47/10; H05B 47/105; H05B 47/155; H05B 47/165; H05B 47/175; H05B 47/195

See application file for complete search history.

(56) References Cited

U.S. PATENT DOCUMENTS 6,140,921 A 10/2000 Baron et al.
7,246,045 B1 7/2007 Rappaport et al.

(Continued)

FOREIGN PATENT DOCUMENTS

CN 201042620 Y 4/2008
JP H0567279 A 3/1993
WO 2018030987 2/2018

OTHER PUBLICATIONS

Frost Museum of Science—Bright Logic, © Brightlogic 2019, "Frost Museum's Active Floor System", https://www.brightlogic.com/showcase/frost-museum-of-science, Apr. 27, 2020 (2 pages).

(Continued)

*Primary Examiner* — Tung X Le
(74) *Attorney, Agent, or Firm* — Snell & Wilmer LLP

(57) ABSTRACT

A light system configured for reserving and/or dynamically moving/arranging spaces for participants in a class may include a plurality of cells disposed on a surface, each cell having one or more lights disposed therein. Each light is in communication with a controller configured to control at least one of a color, a pattern, and a brightness of each light. The light system may be configured to allow a participant of the class to reserve a space prior to the class and have the space emit light indicating the space is reserved proximate a start time of the class.

18 Claims, 14 Drawing Sheets

Related U.S. Application Data

(60) Provisional application No. 62/812,388, filed on Mar. 1, 2019.

(51) Int. Cl.

| | |
|---|---|
| ***F21V 33/00*** | (2006.01) |
| ***H05B 47/155*** | (2020.01) |
| *F21W 131/407* | (2006.01) |

(56) References Cited

U.S. PATENT DOCUMENTS

| | | | | |
|---|---|---|---|---|
| 8,235,870 | B2 | 8/2012 | Hamilton | |
| 9,442,888 | B2 | 9/2016 | Stanfield et al. | |
| 10,034,352 | B2 * | 7/2018 | Bowser | H05B 45/46 |
| 10,342,106 | B1 * | 7/2019 | Chen | H05B 47/19 |
| 2005/0237733 | A1 | 10/2005 | Laski | H05B 45/20 362/147 |
| 2007/0211463 | A1 | 9/2007 | Chevalier | |
| 2010/0301776 | A1 | 12/2010 | Feri et al. | |
| 2015/0008827 | A1 * | 1/2015 | Carrigan | H05B 47/115 315/131 |
| 2015/0012307 | A1 | 1/2015 | Moss | |
| 2016/0037293 | A1 | 2/2016 | Jovicic et al. | |
| 2016/0360594 | A1 | 12/2016 | Chemel | |
| 2019/0259108 | A1 | 8/2019 | Bongartz et al. | |
| 2019/0350066 | A1 * | 11/2019 | Herf | H05B 47/105 |
| 2020/0060007 | A1 | 2/2020 | Harrison | G06T 15/08 |
| 2020/0124272 | A1 * | 4/2020 | Spencer | H04R 7/122 |

OTHER PUBLICATIONS

The Walker—Energy Floors, https://energy-floors.com/the-walker/, Apr. 27, 2020 (4 pages).

* cited by examiner

LIGHT SYSTEM

CROSS-REFERENCE TO RELATED APPLICATIONS

This application is a continuation of U.S. patent application Ser. No. 16/805,324 entitled "LIGHT SYSTEM" and filed on Feb. 28, 2020, which is a nonprovisional of, and claims priority to, and the benefit of U.S. Provisional Application No. 62/812,388 entitled "LIGHT SYSTEM" and filed on Mar. 1, 2019, each of which is hereby incorporated by reference in its entirety.

BACKGROUND

Field

The invention relates to a system and a method for using lights.

Description of the Related Art

Conventional yoga studios include an open space for participants to place yoga mats on the ground and participate in a yoga class. Certain areas of the open space may be more or less desirable by the participants, and in many cases, participants may show up early to a yoga class to claim these certain areas.

SUMMARY

What is described is a system for reserving spaces for a class. The system includes a plurality of cells located along a surface, each cell of the plurality of cells having a cavity underneath the surface, the cavity housing one or more lights. The system also includes a transceiver configured to receive reservation data from a user device indicating a selected space associated with a participant. The system also includes a processor communicatively coupled to each of the lights in the plurality of cells and configured to identify one or more cells of the plurality of cells associated with the selected space associated with the participant, and adjust a color emitted by lights of the identified one or more cells to indicate that the selected space associated with the participant is reserved.

Also described is a system for reserving spaces for a class. The system includes a plurality of cells on a surface, each cell of the plurality of cells having one or more lights; a floor controller electrically coupled to the one or more lights of each cell of the plurality of cells, the floor controller configured to: receive a first reservation data for a first space, the first space defined by a first portion of cells of the plurality of cells; and command the one or more lights of the first portion of cells to emit at least one of a first color or a first pattern proximate a start time of the class.

Also described is a method for dynamically reserving spaces for a class. The method includes receiving, by a transceiver, a reservation data for the class; and commanding, by a processor, a first space to emit a first color or a first pattern proximate a start time of the class, the first space defined by a portion of cells of a plurality of cells on a surface.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Figure 1:
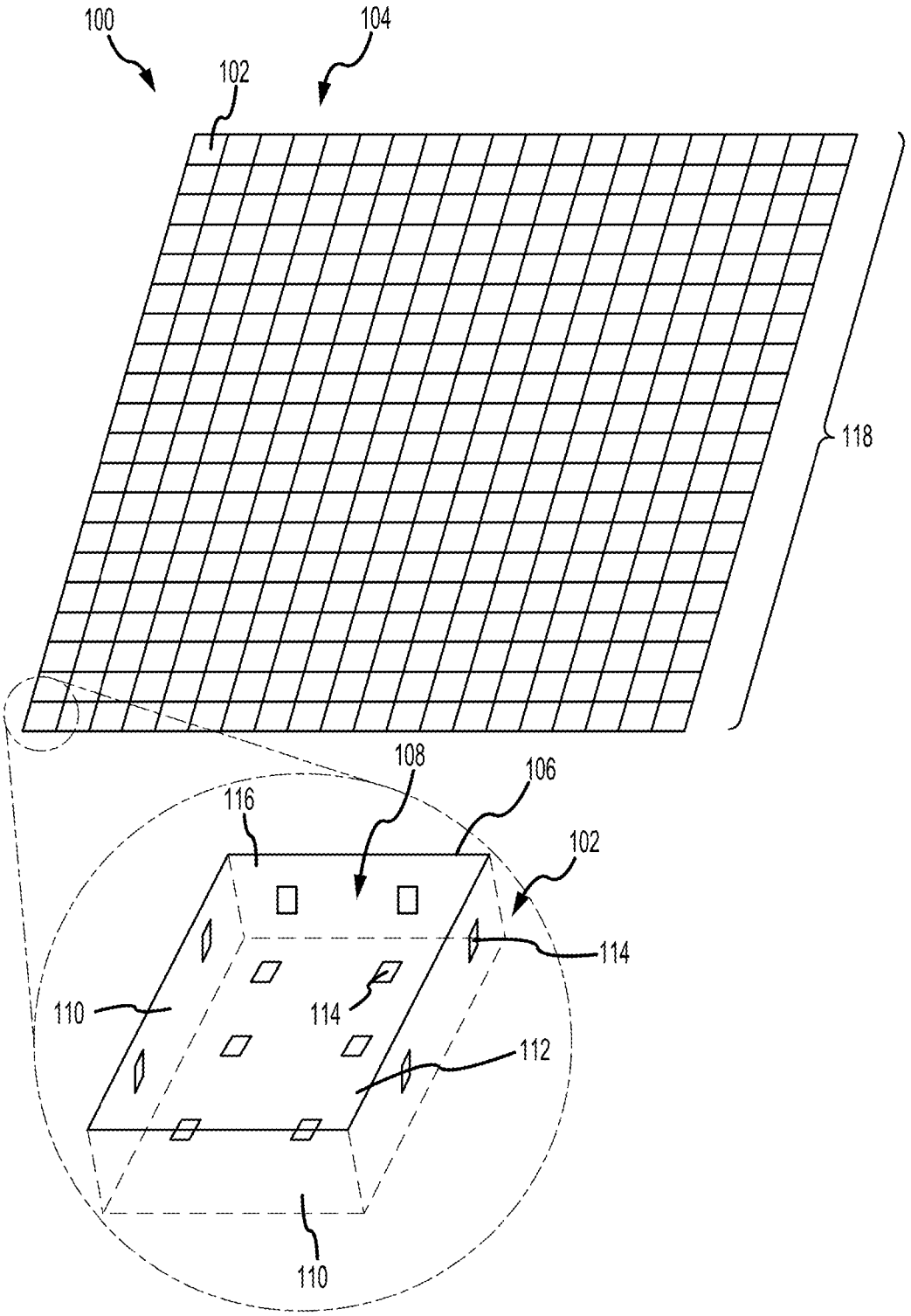
FIG. 1 illustrates a light system, according to various embodiments of the invention.

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

Disclosed herein, in accordance with various embodiments, is a light system configured for reserving and/or dynamically moving/arranging spaces for participants in a class, such as a yoga class, a strength class, a meditation class, etc. The light system is coupled to a floor controller. The floor controller is configured to instruct the light system to display various colors, patterns, and/or brightness. The floor controller is in electrical communication with a plurality of lights in the light system. The light system may be embedded below a surface, such as a floor. In various embodiments, the light system may allow a plurality of users to reserve spaces in a respective class remotely. Upon arriving to the class, the user may identify their reserved space as a customized pattern or color or by a reserved color. The reserved space may match a floor location corresponding to a virtual floor location on a user device used to reserve the space. In various embodiments, by allowing users to reserve spaces dynamically prior to a class, a user may be able to arrive to class closer to the start time without worrying about having a space in the class and having a preferred space.

The systems and methods described herein improve existing computer-based methods of enrolling in classes, such as yoga classes, by visually providing an indication on the real-life floor of occupied or reserved spaces. The systems and methods described herein also provide capabilities of displaying patterns using the lights of the floor to create a desired ambience in a class. The systems and methods described herein improve existing technology by dynamically adjusting spaces to most efficiently accommodate a maximum number of participants.

FIG. 1 illustrates a light system 100. The light system 100 includes a plurality of cells 102 arranged along a surface 104, such as a floor. Each cell 102 may include a cavity 108 that is below the surface 104. The cavity 108 may house one or more lights 114 configured to provide colored light. The cavity 108 may be defined by one or more walls 110 and a bottom surface 112. The lights 114 may be located on the one or more walls 110 and/or the bottom surface 112. The cavity 108 may be covered by a lid 116 that contacts the one or more walls 110 along a top perimeter 106. The lid 116 may be transparent or semi-transparent to allow the light provided by the one or more lights 114 to be seen from outside of the cavity 108. The lid 116 and the one or more walls 110 may provide sufficient strength to allow a human to stand or lay or jump on top of the cells 102.

In some embodiments, there may be a rubber layer located below the bottom surface 112. The bottom surface 112 and the walls 110 may be made of wood or other rigid and durable material. The lid 116 may be made of acrylic or other rigid, transparent or semi-transparent material. A layer of epoxy may cover the lid 116 and/or the entire surface 104 to increase the durability of the floor surface 104.

The cells 102 may be arranged within a room or other space in an array 118. While the array 118 is shown as being a 20 by 20 matrix of cells 102, the array 118 may be of any width or length or overall shape in order to fit within a room or other space. While the system 100 shows the cells as being square-shaped, the cells may be of any shape, such as circular, rectangular, or hexagonal, for example.

The one or more lights 114 may be controlled by a computing device or controller configured to communicate instructions to each light of the one or more lights 114. The instructions may include instructions to turn on, to turn off, to emit a particular color, or to emit light at a particular brightness, for example. The computing device may coordinate the display of light from each of the one or more lights 114 to create various patterns or designs. These patterns or designs may serve to attract the attention of individuals, soothe individuals, and/or provide an indication of a reserved space for individuals.

Figure 2:
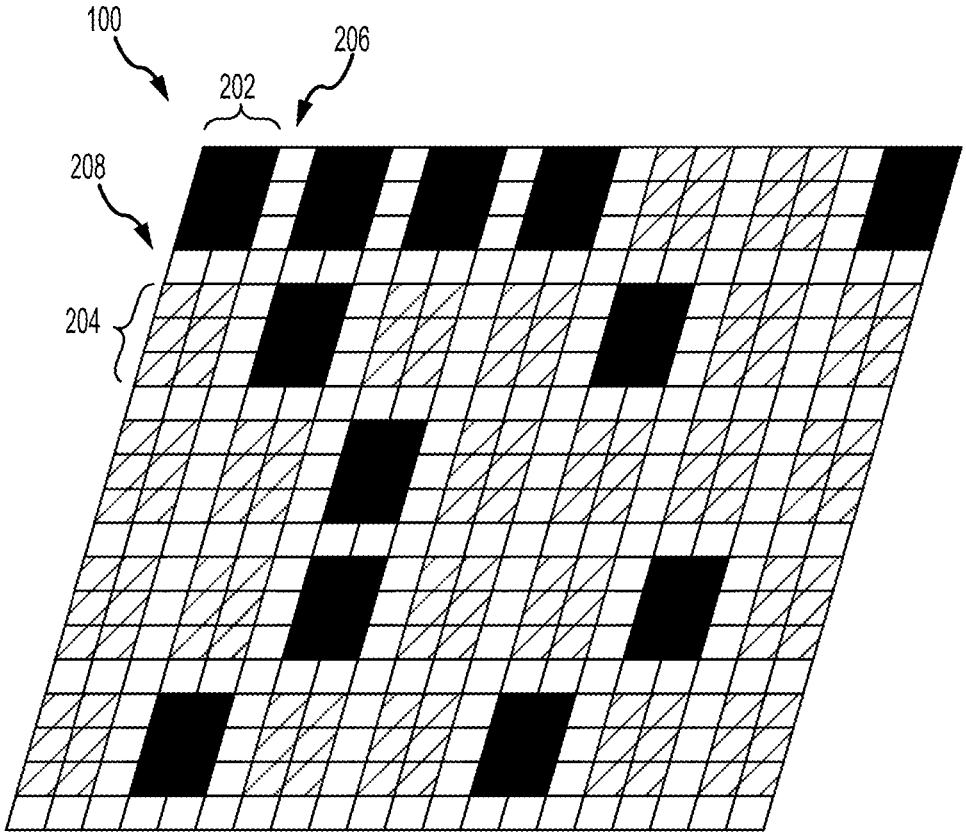
FIG. 2 illustrates the system of FIG. 1 with two different colors of lights used to identify different spaces, according to various embodiments of the invention.

The individual cells 102 may be used to delineate spaces for individual yoga participants. FIG. 2 illustrates the system 100 with two different colors of lights used to identify different spaces. A first space 202 may be associated with a first color 206. The first color 206 may indicate to a viewer that the particular space is taken or reserved. In order to display the first color 206, all of the lights 114 in the cells 102 of the first space 202 may emit a same color at a same brightness. In some embodiments, the first color 206 is a combination of colors or a moving pattern or design achieved by a coordinated emission of light from the lights 114 of the cells 102 of the first space 202.

A second space 204 may be associated with a second color 208. The second color 208 may indicate to a viewer that the particular space is available. In order to display the second color 208, all of the lights 114 in the cells 102 of the second space 204 may emit a same color at a same brightness. In some embodiments, the second color 208 is a combination of colors or a moving pattern or design achieved by a coordinated emission of light from the lights 114 of the cells 102 of the second space 204.

In this way, the system 100 shows individuals the available spaces and the taken spaces. Further, a uniform distribution of distance between spaces may be maintained to optimize the number of spaces that can fit within a room or area.

In some embodiments, all the spaces in a respective yoga class are the same size (e.g., 5 cells by 10 cells). In some embodiments, the space sizes may be varied based on a specific class. For example, a yogalates class may have a fixed space size of 4 cells by 8 cells, whereas a strength class may have a fixed space size of 6 cells by 12 cells. The space size(s) used for a particular class may be stored as space size data associated with the particular class.

In some embodiments, all the spaces may have a default size and a user may indicate whether the user would like to select a larger space (e.g., a default size may be 4 cells by 8 cells and a user may select a 5 cell by 10 cell space). In some embodiments, when a user selects a larger space than the default space, the user may receive a notification to pay extra by a payment method, such as a credit card, a debit card, credits, or any other payment method known in the art, or may receive a notification of an increased charge due at class.

Figure 3:
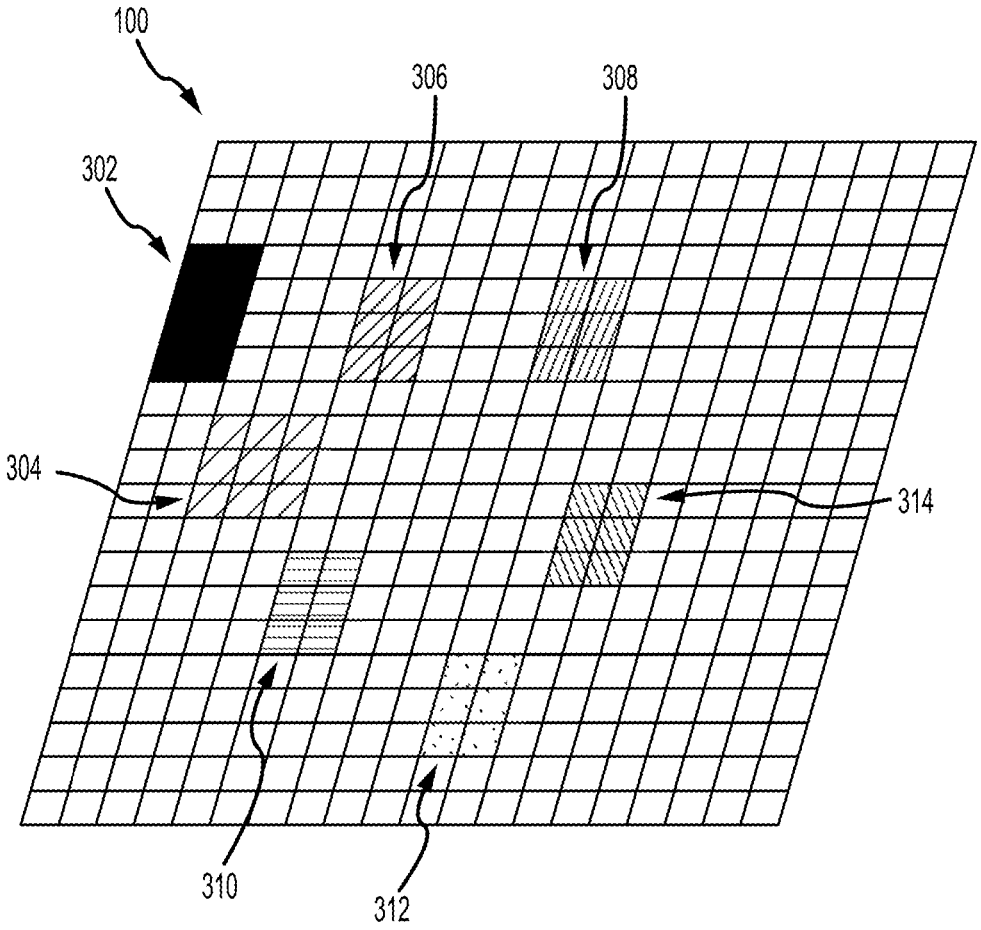
FIG. 3 illustrates the system of FIG. 1 with various spaces having various dimensions and colors, according to various embodiments of the invention.

In some embodiments, each reserved space may comprise a different color. In this regard, each reserved space may correspond to a color associated with a specific participant in a class. Individual participants may have different space shapes and/or colors to identify their space apart from other participants' spaces. FIG. 3 shows the system 100 with a first space 302 having a first color and a first size dimension (e.g., 2 cells by 4 cells); a second space 304 having a second color and a second size dimension (e.g., 3 cells by 3 cells); a third space 306 having a third color and a third size dimension (e.g., 2 cells by 3 cells); a fourth space 308, a fifth space 310, a sixth space 312, and a seventh space 314, each having different colors. In each of the spaces 302-314, a design or pattern of lights may be used instead of or in addition to a particular color.

In some embodiments, each participant may have an online account where their colors and/or patterns of light can be personalized. Each participant's size of space may also be adjusted. For example, a first participant may adjust the first participant's space specifications (e.g., color, pattern, size) on a mobile device of the first participant, and a server associated with the yoga studio may receive and store the first participant's space specifications. When the first participant reserves or claims a space at the yoga studio, the first participant's space specifications may be accessed from the server, and the lights of the corresponding cells may emit particular colors, intensities, and patterns of light accordingly.

Figure 4A:
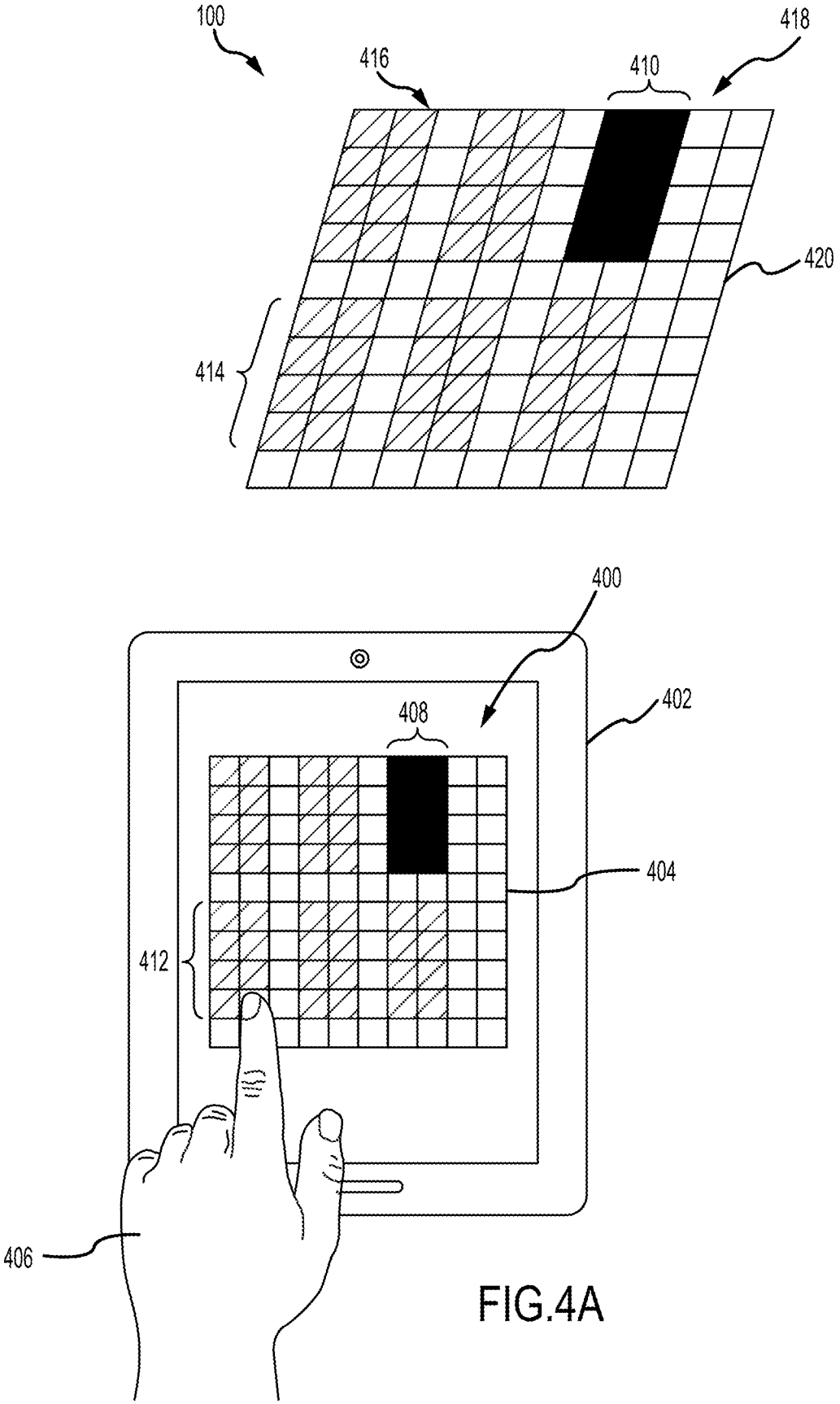
FIGS. 4A-4B illustrate a process of claiming or reserving a space, according to various embodiments of the invention.
Figure 4B:
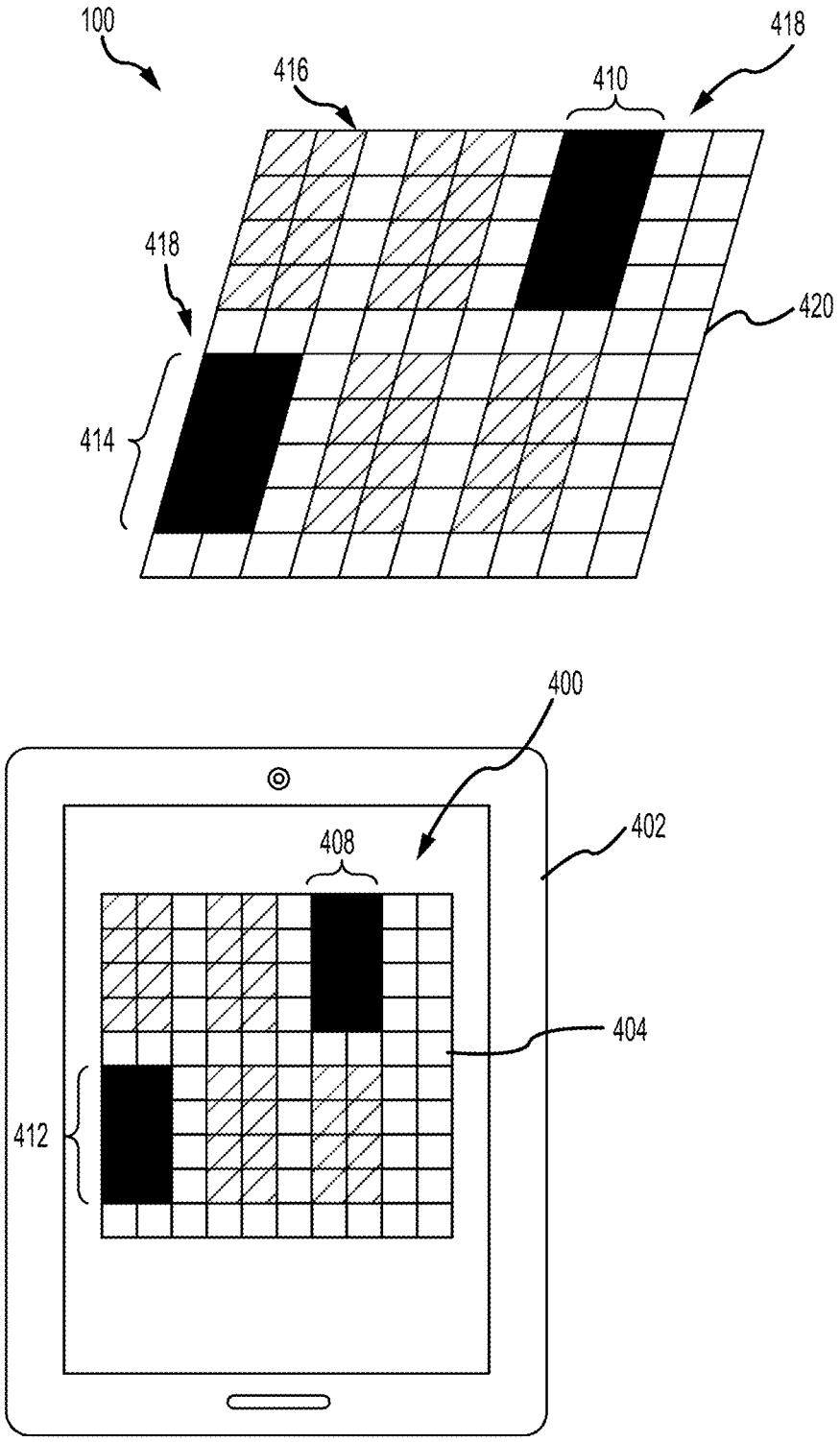

FIGS. 4A-4B illustrate a process of claiming or reserving a space. The system 100 displays multiple spaces using a matrix of cells 102 arranged along a real-life grid 420. As shown in FIG. 4A, there is a first space 410 that has a first color 418 that indicates that the first space 410 is taken. There is also a second space 414 that has a second color 416 that indicates that the second space 414 is not taken.

A mobile device 402 may display on a graphical user interface 400 a virtual grid 404 corresponding to the real-life grid 420. The graphical user interface 400 shows a virtual first space 408 corresponding to the real-life first space 410 as well as a virtual second space 412 corresponding to the real-life second space 414.

A participant 406 who wishes to join the yoga class may select the virtual second space 412 on the graphical user interface 400. The mobile device 402 may be a mobile device of the participant 406, and the participant may be remotely located from the real-life grid 420. In some embodiments, the mobile device 402 is a mobile device of the yoga studio and located proximal to the real-life grid 420.

As shown in FIG. 4B, when the participant 406 selects the virtual second space 412, the real-life second space 414 is now in the first color 418, which indicates that it is taken. As described herein, in some embodiments, the real-life second space 414 may have a color and/or pattern or design associated with the participant 406.

The claiming or reserving of the spaces may be performed in real-time in order to allow those viewing the spaces remotely and in person to know which spaces are taken and which spaces are available.

Figure 5A:
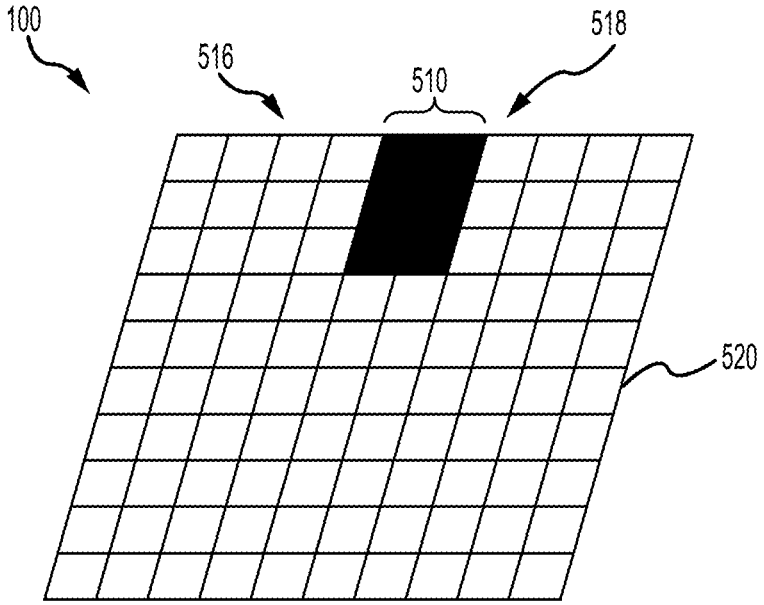
FIGS. 5A and 5B illustrate the process of reserving or claiming spaces dynamically, according to various embodiments of the invention.
Figure 5A:
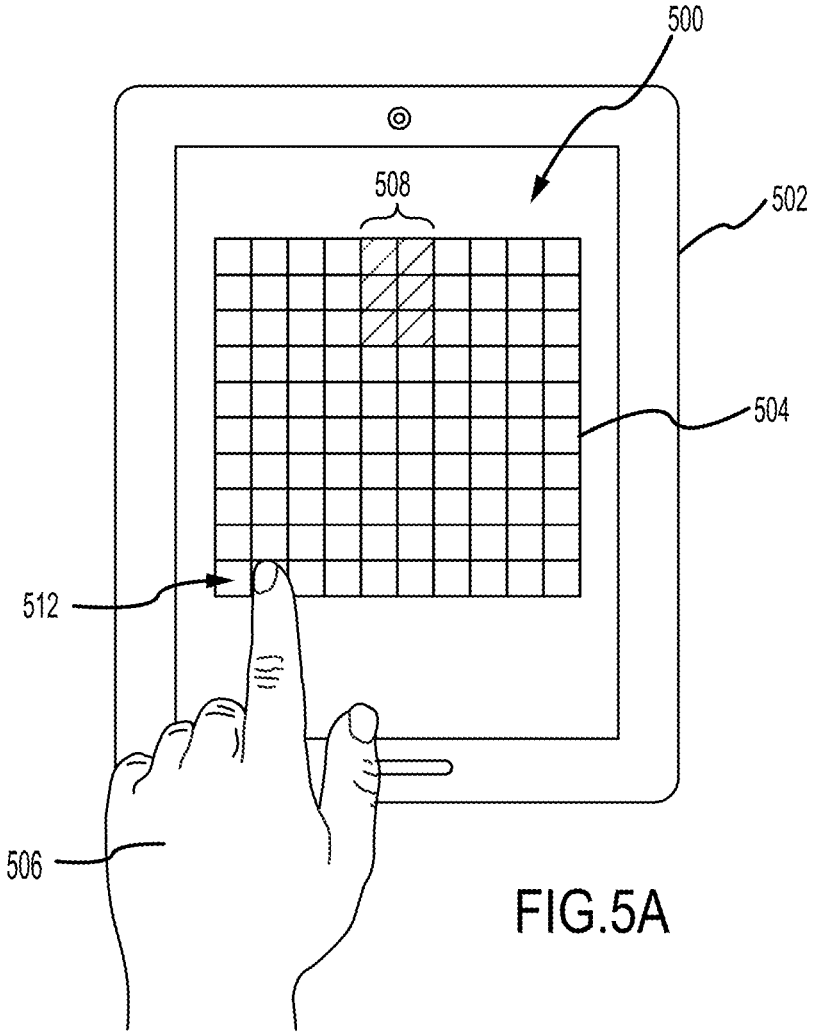
Figure 5B:
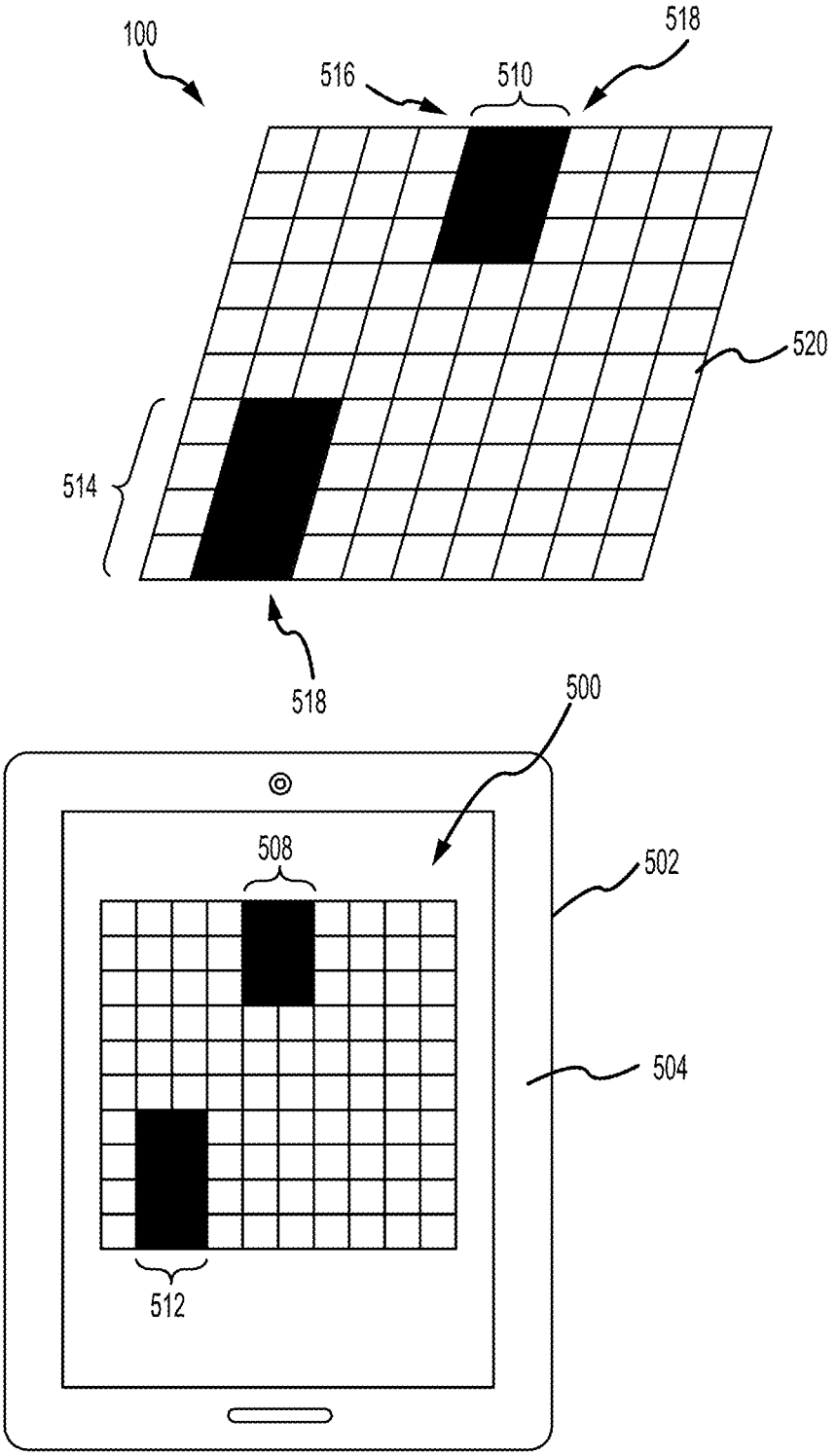

In some embodiments, instead of a predetermined arrangement of spaces, as shown in FIGS. 4A and 4B, the spaces and locations of the spaces may be chosen by the participants. FIGS. 5A and 5B illustrate the process of reserving or claiming spaces dynamically.

The system 100 displays multiple spaces using a matrix of cells 102 arranged along a real-life grid 520. As shown in FIG. 5A, there is a first space 510 that has a first color 518 that indicates that the first space 510 is taken. The remaining non-taken cells are in a second color 516.

A mobile device 502 may display on a graphical user interface 500 a virtual grid 504 corresponding to the real-life grid 520. The graphical user interface 500 shows a virtual first space 508 corresponding to the real-life first space 510. The mobile device 502 may be a mobile device of the participant 506, and the participant may be remotely located from the real-life grid 520. In some embodiments, the mobile device 502 is a mobile device of the yoga studio and located proximal to the real-life grid 520.

A participant 506 who wishes to join the yoga class may select a desired location 512 on the graphical user interface 500. As shown in FIG. 5B, when the participant 506 selects the desired location 512, a real-life second space 514 is now in the first color 518, which indicates that it is taken. As described herein, in some embodiments, the real-life second space 514 may have a size, color, and/or pattern or design associated with the participant 506.

The claiming or reserving of the spaces may be performed in real-time in order to allow those viewing the spaces remotely and in person to know which spaces are taken and which spaces are available.

Figure 6A:
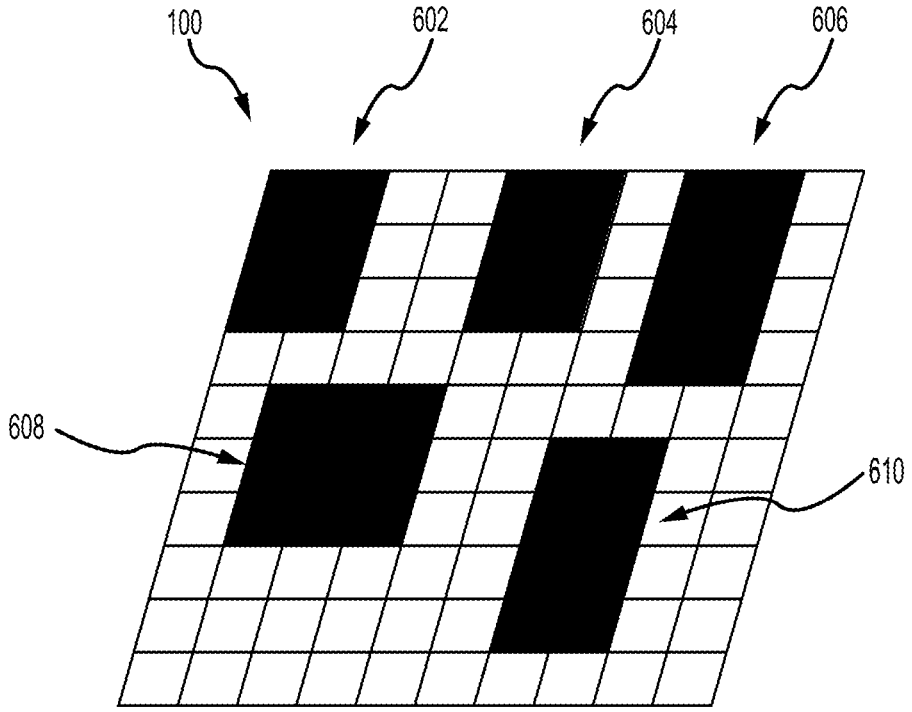
FIGS. 6A-6B illustrate a process of automatically rearranging claimed or reserved spaces, according to various embodiments of the invention.
Figure 6B:
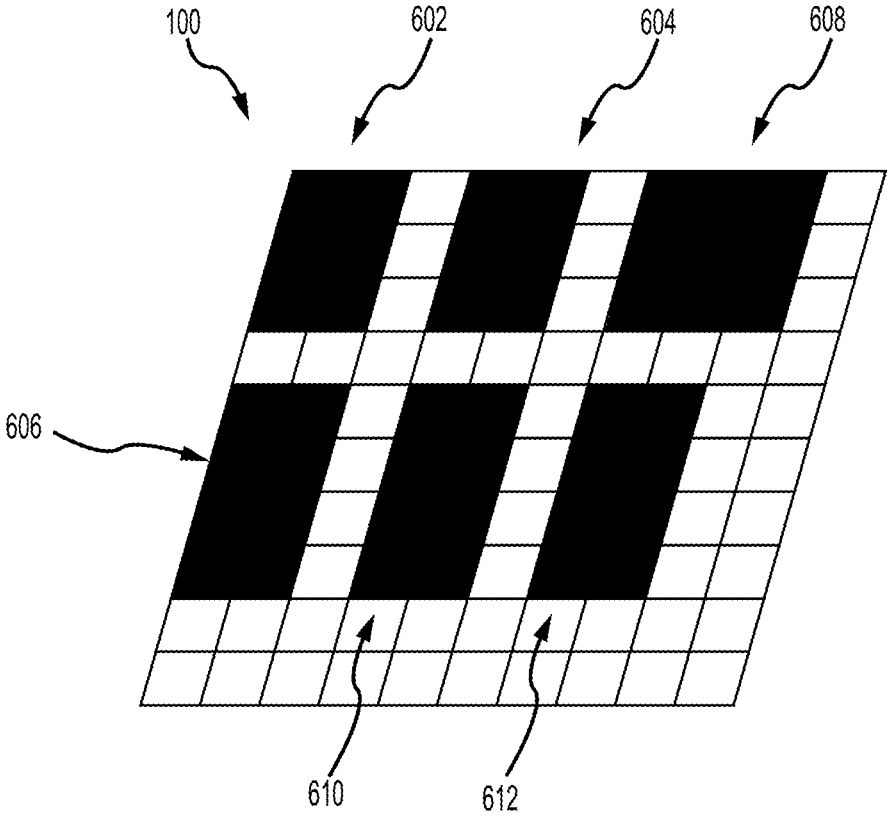

When participants are allowed to dynamically choose their spaces in the room, there may be a sub-optimal arrangement of spaces. FIGS. 6A-6B show a process of automatically rearranging claimed or reserved spaces.

As shown in FIG. 6A, the system 100 displays a first space 602, a second space 604, a third space 606, a fourth space 608, and a fifth space 610. The spaces 602-610 may be of varying shapes and sizes. However, as currently arranged, a sixth space could not be arranged without having two spaces adjacent to each other without a buffer. Yet, if the spaces were rearranged, a sixth space could be accommodated.

When the system 100 receives a request for an additional space, the system 100 may automatically determine a rearrangement of the existing spaces 602-610 in order to accommodate an additional space. Whether the existing spaces 602-610 may be rearranged in order to accommodate the additional space may be based on the size and dimensions of the requested additional space. For example, an additional 2 cell by 4 cell space may be accommodated, but a 5 cell by 5 cell space may not be accommodated.

FIG. 6B illustrates the system 100 with the existing spaces 602-610 rearranged to accommodate a sixth space 612.

In some embodiments, the cells 102 may include weight sensors, and the lights 114 may change based on the weight detected by the weight sensors. In some embodiments, the cells 102 may adjust shape or colors during the yoga class to correspond to the yoga move currently being performed by the instructor. For example, certain portions of each space may dynamically change to indicate where the participant's feet or hands should be located, and these portions of each space which change color may change based on the height, weight, and/or reach of the participant.

In some embodiments, when the class begins, any remaining cells which are not occupied by a participant may display colors and/or patterns corresponding to the yoga class. For example, to calm the participants, a soothing pattern and/or colors may be displayed by the cells. In some embodiments, when the class begins, all cells, regardless of occupancy, may display colors and/or patterns corresponding to the yoga class for a duration of time, and after conclusion of the duration of time, the cells may be lighted to again indicate occupancy. For example, the duration of time may correspond to a meditation segment of the yoga program not involving any movement from the participants. Thus, the occupancy lights may not be as important to display as an unbroken pattern. However, when the meditation segment is concluded and yoga moves are resumed, the occupancy lights may be re-displayed.

While the systems and methods are described herein with respect to yoga and a yoga class, the systems and methods described herein may be used for any class or any situation where spaces can be dynamically assigned and arranged.

The lights 114 of the cells 102 may be controlled by a computing device having a processor and a non-transitory memory for storing instructions to be performed by the processor. The computing device may be connected to one or more other computing devices (e.g., mobile devices) via a network, such as the Internet.

Figure 7:
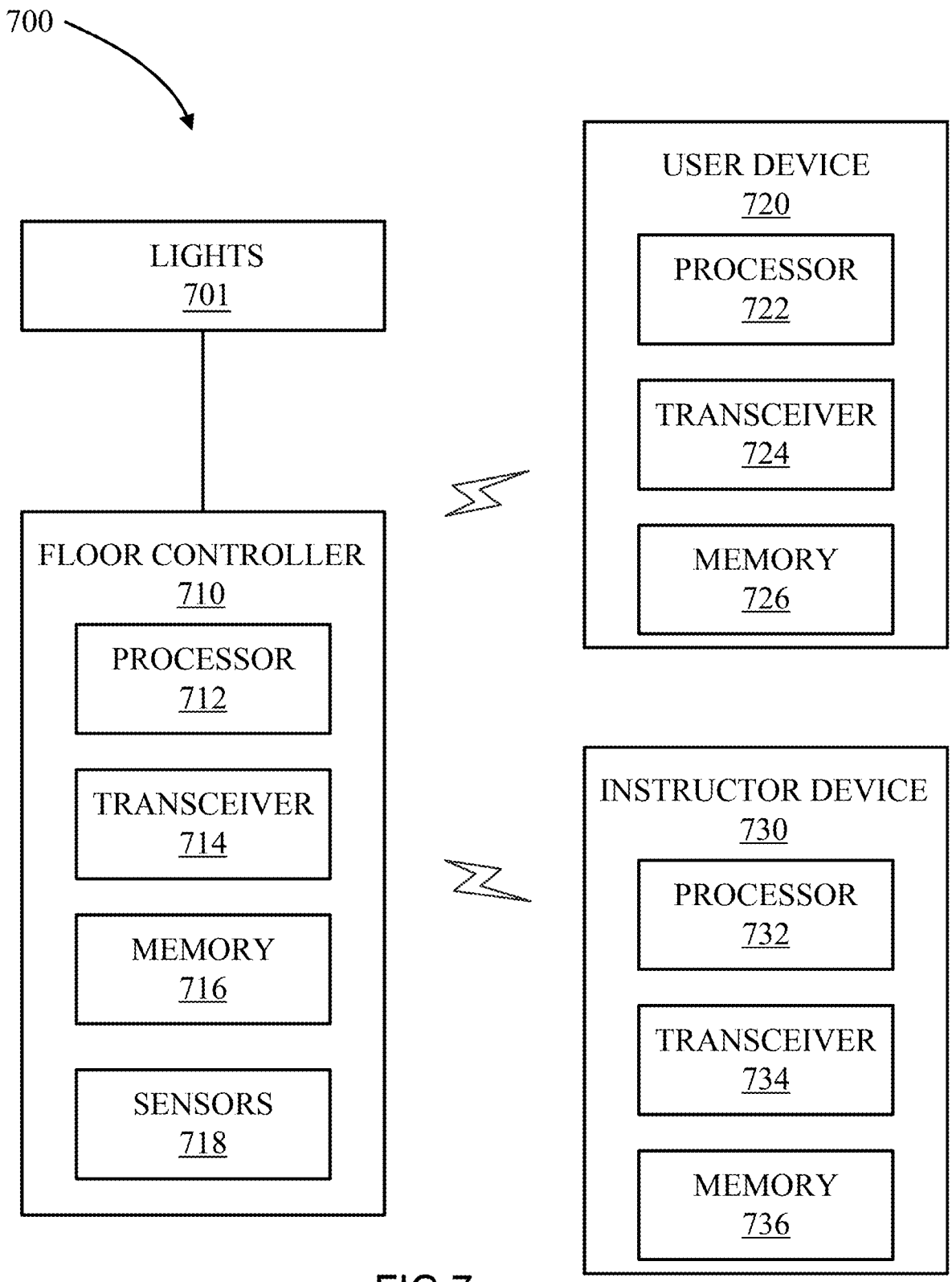
FIG. 7 illustrates a computer-based system of reserving a space, according to various embodiments of the invention.

FIG. 7 illustrates a system 700. The system 700 includes a floor controller 710, a user device 720, an instructor device 730, and lights 701. Although only a single user device 720 is illustrated, a multitude of user devices is within the scope of this disclosure. For example, in various embodiments, a plurality of user devices 720 may communicate with the floor controller 710. In various embodiments, the user device 720 may be in accordance with mobile device 402 or mobile device 502. In some embodiments, the user device 720 is a single user device located within the yoga studio. In some embodiments, the user device 720 is one of many user devices (e.g., smartphone, tablet, laptop, personal computer) corresponding to different users or participants.

The floor controller 710 includes a processor 712, a transceiver 714, and a memory 716. The floor controller 710 may be appropriately programmed, to control one or more operations of the light system 100. The floor controller 710 may be implemented as a single floor controller or in multiple floor controllers. The floor controller 710 may be electrically coupled to the lights 701 (e.g., lights 114). In some embodiments, the floor controller 710 is a central floor controller configured to control one or more operations of the cells 102 of the floor 104. In some embodiments, the floor controller 710 is multiple floor controllers located within the floor 104 and each configured to control one or more local operations of the floor 104, including the lights. In some embodiments, the floor controller 710 is one or more computer processors or controllers configured to execute instructions stored in a non-transitory memory 716.

When reference is made herein to the floor controller 710 performing a function, the processor 712 of the floor controller 710 performs the function or instructs another device (e.g., transceiver 714, lights 701) to perform the function. Likewise, when reference is made herein to the user device 720 performing a function, the processor 722 of the user device 720 performs the function or instructs another device (e.g., transceiver 724) to perform the function. Similarly, when reference is made herein to the instructor device 730 performing a function, the processor 732 of the instructor device 730 performs the function or instructs another device (e.g., transceiver 734) to perform the function.

The floor controller 710 may use user data along with floor map data stored in memory 716 to determine available spaces and reserved spaces. In some embodiments, the user data and floor map data may be stored in a memory 736 of the instructor device 730. In some embodiments, the available spaces and the reserved spaces may be fixed in size based on a specific class (e.g., a yogalates class may have a smaller default space, such as 4 cells by 8 cells compared to a strength class, such as 6 cells by 12 cells). In this regard, a fixed space size may be tailored to a specific class. In other embodiments, a user may select a larger space than a default space size. The available spaces and the reserved spaces may be reflected by the space reservation data. The space reservation data may include a computer-readable table indicating a user or color associated with each cell of the floor. The user may be associated with a particular color or pattern stored in memory. The floor controller 710 may be configured to interpret the space reservation data to automatically illuminate the cells based on the space reservation data.

The memory 716 is connected to the processor 712 and the transceiver 714 and may be connected to any other component of the floor controller 710. The memory 716 is configured to store any data described herein, such as the space reservation data, the floor map data, the user data, and/or data received from the user device 720 or instructor device 730 via the transceiver 714.

The floor controller 710 may be coupled to a network. The network, such as a local area network (LAN), a wide area network (WAN), a cellular network, a digital short-range communication (DSRC), LORA (Long Range), the Internet, or any other type of interconnectivity or combinations thereof, connects the floor controller 710 to the user device 720 and/or the instructor device 730.

The transceiver 714 may include a communication port or channel, such as one or more of a Wi-Fi unit, a Bluetooth® unit, a Radio Frequency Identification (RFID) tag or reader, a DSRC unit, a LORA unit, or a cellular network unit for accessing a cellular network (such as 3G, 4G, or 5G) or any other wireless technology. The transceiver 714 may transmit data to and receive data from devices and systems not physically connected to the floor controller 710. For example, the floor controller 710 may communicate with the user device 720 and/or the instructor device 730. Furthermore, the transceiver 714 may access the network, to which the user device 720 and/or the instructor device 730 are also connected.

The floor controller 710 of the system 700 determines whether, where, and at what brightness lights 701 are illuminated. In some embodiments, the floor controller 710 may be configured to coordinate the display of light from each of the one or more lights 701 to create various patterns or designs. In some embodiments, the floor controller analyzes the floor map data (e.g., reservation data for spaces) to determine whether the floor map may be re-arranged to accommodate an additional user. Floor map data from the memory 716 and user data received from a user device 720 may also be used to determine whether the user may be accommodated for a specific size space.

The floor controller 710 may also operate with a driver for controlling the operations of the lights. The driver may be communicatively coupled to the floor controller 710 and the lights 701. When the floor controller 710 is described herein as controlling the lights 701, the floor controller 710 may communicate instructions to the driver to control the lights 701.

Ambiance data associated with segments of various classes and/or coordinated with specific music may be stored in memory 716. In this regard, for example, a meditation segment may begin, and in response to music for the meditation segment playing, the floor controller 710 may command the lights 701 to illuminate based on the ambiance data. The ambiance data may include floor patterns and/or floor scenes to be displayed by the lights 701, and the ambiance data may be programmed for display in response to a respective music segment playing. Thus, the ambiance data may be a series of color and brightness instructions for each of the lights of the cells to create the floor patterns and/or floor scenes. The ambiance data may be determined by the floor controller 710 based on music data from the instructor device 730, or the ambiance data may be pre-programmed into the processor 712 of the floor controller 710.

Body placement data associated with a respective class may be stored in memory 716. In this regard, for example, a space may light up to indicate to a participant that a body part is supposed to be placed in the space that is lit up. The body placement data may be correlated with a class schedule data, a music data, or the like. In some embodiments, an instructor may input class schedule data into the instructor device 730 indicating each pose to be performed throughout a class and/or a time frame for each pose. In response to receiving the class schedule, the floor controller 710 may command the light system to light up based on the body placement data, the class schedule data, and the floor map data. In some embodiments, the instructor may input music data and body placement data into the instructor device 730 indicating each pose to be performed throughout a class based on the music data. In this regard, the lights 701 may illuminate based on the music data and the body placement data and not based on a specific time or class schedule. In some embodiments, this may allow a class to start early or late, and the schedule of the body placement data may be maintained by being correlated with the music data.

In some embodiments, body placement data may further be based on user data provided by user device 720. User data may include height, weight, reach, and/or any other user data that may be utilized for determining body placement during various poses. User data may be input on the user device 720 and stored in memory 726. The user data may be transmitted to the floor controller 710 from transceiver 724 to transceiver 714.

When determining the body placement data, the floor controller 710 may use machine learning techniques and training data to identify the relative distance for body placement of the participant associated with a reserved space for the respective participant. The floor controller 710 may also use machine learning techniques to identify a corrected height, weight, reach, and/or any other user associated data for a specific user. For example, in some embodiments, floor controller 710 may further comprise sensors 718. Sensors 718 may comprise a weight sensor, or the like. Sensor 718 may be configured to detect whether a participant has placed any weight on a given cell on the floor. The weight data from sensors 718 may be stored in memory 716 and correlated to a respective user. In some embodiments, the weight data from sensors 718 may be correlated with body placement data to identify the corrected height, weight, reach, and/or any other user associated data for a specific user. The sensors 718 may be located alongside the lights within the cavity of the cell.

The sensors 718 may also be used to identify spaces that have been occupied. For example, a participant may not reserve a space using the systems and methods described herein, and the participant may simply show up to the class and occupy a space that is identified (by lights) as being unoccupied. The sensors 718 may detect the presence of a participant on this unoccupied space, and may automatically change the color of the lights of the space to indicate that the space has been occupied. Further, the floor controller 710 may update the memory to indicate that the now-occupied space is occupied, so other participants may not attempt to accidentally reserve a space that is now currently occupied. In this way, a real-time update is provided to those wishing to reserve a space remotely.

The user device 720 includes a processor 722, a transceiver 724, and a memory 726. The user device 720 may be a device configured to provide user data associated with a participant for a respective class. "User data," as described herein, may be any data associated with a specific user (e.g., a name, a payment method, such as a credit card, debit card, or the like, a height, a weight, a reach, or any other characteristic data pertinent to a reservation or a class known in the art). The user device 720 may further be configured to provide reservation data associated with a participant for a respective class.

The user device 720 may comprise any suitable hardware, software, and/or database components capable of sending, receiving, and storing data. For example, user device 720 may comprise a personal computer, personal digital assistant, cellular phone, smartphone (e.g., IPHONE®, BLACKBERRY®, and/or the like), IoT device, kiosk, and/or the like. User device 720 may comprise an operating system, such as, for example, a WINDOWS® mobile operating system, an ANDROID® operating system, APPLE® IOS®, a BLACKBERRY® operating system, a LINUX® operating system, and the like. User device 720 may also comprise software components installed on user device 720 and configured to transmit information, via transceiver 724, to floor controller 710. For example, user device 720 may comprise a web browser (e.g., MICROSOFT INTERNET EXPLORER®, GOOGLE CHROME®, etc.), an application, a micro-app or mobile application, or the like, configured to allow the user device to transmit user data and reservation data with floor controller 710.

In various embodiments, user device 720 may be configured to communicate with and/or interact with floor controller 710 via a user interface. The user interface may comprise a graphical user interface (GUI) accessible via a mobile application, web browser, software application, or the like. For example, user device 720 may interact with the user interface to reserve spaces for a respective class. The user data transferred from the user device 720 to the floor controller 710 may specify a spatial location on a floor map, a size for the space (e.g., 5 cells by 10 cells, 6 cells by 12 cells, etc.), a class time (e.g., 7:00 AM, 8:00 AM, etc.), a name associated with the reservation, and/or any additional information pertinent to a participant in the respective class. In some embodiments, the size of the spaces (e.g., 5 cells by 10 cells, 6 cells by 12 cells, etc.) may be fixed for a given class (e.g., 4 cells by 8 cells for a yogalates class or 6 cells by 12 cells for a strength class. In some embodiments, the size of the spaces may be dynamically chosen for a specific user (e.g., one user may select a 4 cells by 8 cells space while another user may select a 5 cells by 10 cells space based on the user's height or the like). In this regard, a price for a respective participant may be adjusted in response to selecting a space that is larger than a default space for a respective class. For example, in some embodiments, when a user selects a space size that is larger than a default space size, a price for the class may be adjusted by the user device 720 and/or the instructor device 730.

The memory 726 of the user device 720 may be a non-transitory memory configured to store the user data detected by a respective user. The processor 722 may instruct the transceiver 724 to communicate with floor controller 710 and/or the instructor device 730 to communicate data. In some embodiments, the user device 720 provides the reservation data and/or user data to the floor controller 710 and/or the instructor device 730. In some embodiments, the processor 722 of the user device 720 determines reservation data based on user inputs and communicates the reservation data to the floor controller and/or the instructor device 730.

The transceiver 724 may be similar to the other transceivers (e.g., transceiver 714 and transceiver 734) described herein. The processor 722 may be one or more computer processors or controllers configured to execute instructions stored in non-transitory memory (e.g., memory 726).

Participant activity data may be communicated from the floor controller to the user device 720 and/or the instructor device 730 via the transceiver 714 of the floor controller 710, the transceiver 724 of the user device 720, and/or the transceiver 734 of the instructor device 730. Participant activity data may be detected by one or more sensors (e.g., sensors 718) and may indicate a performance and/or presence of a participant at a particular cell.

The instructor device 730 includes a processor 732, a transceiver 734, and a memory 736, all connected to each other via a communications bus. The processor 732 (and any processors described herein) may be one or more computer processors configured to execute instructions stored on a non-transitory memory (e.g., memory 736).

The memory 736 may be a non-transitory memory configured to store class data, such as body placement data, music data, user data, floor map data, space size data, and/or reservation data for a respective class. For example, in some embodiments, an instructor may view a floor map for a respective class, the floor map including reservation data and/or associated user data. In this regard, in some embodiments, an instructor may determine how full or empty a respective class is compared to other classes.

The instructor device 730 may comprise any suitable hardware, software, and/or database components capable of sending, receiving, and storing data. For example, instructor device 730 may comprise a personal computer, personal digital assistant, cellular phone, smartphone (e.g., IPHONE®, BLACKBERRY®, and/or the like), IoT device, kiosk, and/or the like. Instructor device 730 may comprise an operating system, such as, for example, a WINDOWS® mobile operating system, an ANDROID® operating system, APPLE® IOS®, a BLACKBERRY® operating system, a LINUX® operating system, and the like. Instructor device 730 may also comprise software components installed on user device 720 and configured to transmit information, via transceiver 734, to floor controller 710. For example, instructor device 730 may comprise a web browser (e.g., MICROSOFT INTERNET EXPLORER®, GOOGLE CHROME®, etc.), an application, a micro-app or mobile application, or the like, configured to allow the instructor device to transmit ambiance data, floor pattern data, or the like with floor controller 710.

In some embodiments, the instructor device 730 may send ambiance data and/or floor pattern data to the floor controller 710 from the transceiver 734 to the transceiver 714. In this regard, for example, during a class, an instructor may select an ambiance mode via the web browser, the application, the micro-app or mobile application, or the like. In response to receiving the ambiance data and/or floor pattern data, the floor controller 710 may command, via the processor 712, the lights to display floor patterns (e.g., a plurality of candles, a field of grass, etc.). For example, the floor patterns may be utilized while participants in the class are not moving and space delineation is less important.

In some embodiments, the instructor device 730 may change the lights in the system to various modes. For example, near the end of a class, the instructor may select an end of class mode, or the like. In response to the instructor selecting the end of class mode, instructor device 730 may send a floor pattern data to the floor controller 710 from the transceiver 734 to the transceiver 714. In response to receiving the floor pattern data, the floor controller 710 may command, via the processor 712, the lights to blink a color to indicate the class is almost over or to indicate that class has been over for some time and another class is about to begin. For example, the floor controller 710 may command, via the processor 712, the lights to blink red proximate the end of a class or proximate to the beginning of another class.

In some embodiments, the end of class data may be stored in the memory 716 of the floor controller 710. For example, class times may be pre-set in the floor controller 710. In this regard, the floor controller 710 may automatically command the lights to blink a color proximate the end of a class or proximate to the beginning of another class.

Figure 8:
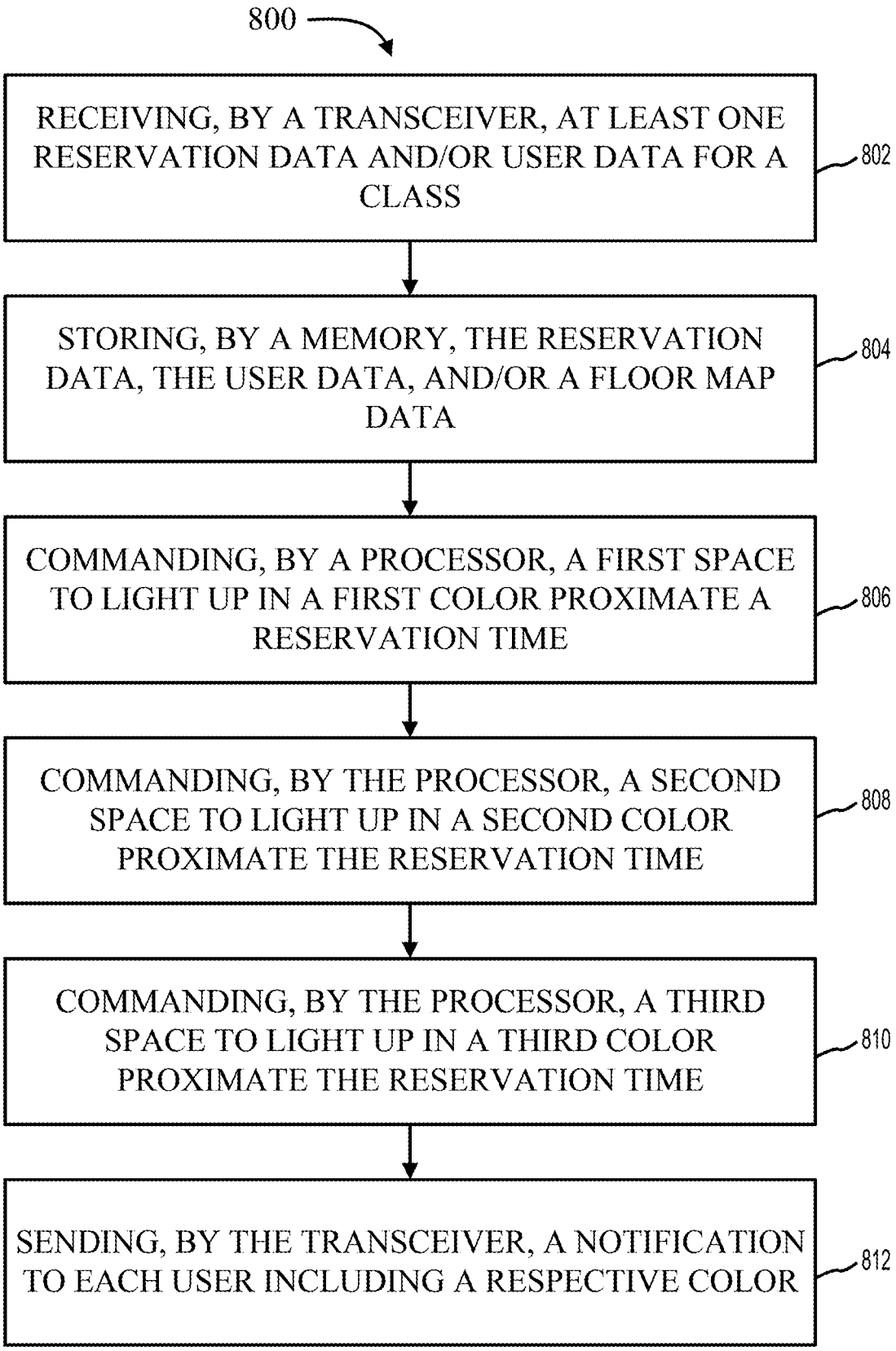
FIG. 8 illustrates a process of the system, according to various embodiments of the invention.

FIG. 8 illustrates a process 800 performed by the system described herein. The process 800 is for dynamically reserving spaces for a respective class, such as a yoga class, a strength class, or any other class known in the art.

An input/output device (e.g., a touchscreen or keyboard or mouse and display) of a user device associated with a participant receives an indication from the participant of a desired space in a particular class. The participant may select a particular space of a plurality of same-sized spaces, as shown in FIG. 4A, or the participant may dynamically select a space of a particular size and dimension, as shown in FIG. 5A. The user device may communicate reservation data (including a selected space and/or start time of class) and/or user data, as described herein, to a floor controller (e.g., floor controller 710).

A transceiver (e.g., a transceiver 714) of the floor controller receives at least one of reservation data and/or user data for a respective class (step 802). The transceiver may include a communication port or channel, such as one or more of a Wi-Fi unit, a Bluetooth® unit, a Radio Frequency Identification (RFID) tag or reader, a DSRC unit, a LORA unit, or a cellular network unit for accessing a cellular network (such as 3G, 4G, or 5G) or any other wireless technology. The transceiver may be a component of a floor controller (e.g., floor controller 710) of a yoga studio. In many embodiments, the reservation data may include a selected space and/or a start time for the class. In many embodiments, the user data may include a name of the user, a color associated with the user, a user identification, a payment method for the user, such as a credit card or a debit card, a height of the user, a reach of the user, and/or a wing span of the user. In various embodiments, the user data includes a name of the user, and the reservation data includes a selected space and a start time of the class.

A memory (e.g., memory 716) of the floor controller stores the reservation data, the user data, and/or a floor map data (step 804). The floor map data includes a virtual grid corresponding to a real-life grid (e.g., virtual grid 404 corresponding to the real-life grid 420 from FIG. 4A). The floor controller (e.g., floor controller 710 of system 700 from FIG. 7) may compare the virtual grid with the reservation data. In some embodiments, the floor controller may assign a space to the user based on the reservation data. The floor controller may reference the reservation data and the floor map data to identify which cells are associated with the reservation data. In doing so, the floor controller may also determine which lights are associated with the cells.

A processor (e.g., processor 712) of the floor controller (e.g., floor controller 710) commands a first space to light up in a first color or pattern proximate the start time of the respective reservation from the reservation data based on the identification of the cells and/or lights associated with the reservation data and/or the user data (step 806). The first color may correspond to a first participant. For example, upon making a reservation, a first user may be assigned a first color to indicate to the user the reserved space upon arriving to the respective class. In some embodiments, the first color or pattern may be customizable by a user. In this regard, the first color may only be displayed when the specific user the first color is associated with is in attendance of a class.

In response to the first color being displayed, the floor controller (via its transceiver) may communicate to the user device (via its transceiver) that the space has been reserved. Subsequent participants wishing to reserve spaces may be notified (via a graphical user interface) that the space has been reserved.

The processor may command a second space to light up in a second color proximate the reservation time (step 808). The second color may correspond to a second participant. For example, upon making a reservation, a second user may be assigned a second color to indicate to the user the reserved space upon arriving to the respective class. The second color may be different from the first color.

The processor may command a second space to light up in a third color proximate the reservation time (step 808). The third color may correspond to an unreserved space. In this regard, when there are remaining spaces available in a class, the third color may depict an unreserved space. The third color is a different color than the first color and the second color. In some embodiments, the first color and the second color may be the same and the third color may be different. In this regard, a reserved space may be a single color and an unreserved space may be a different color.

The transceiver may send a notification to each user who made a reservation for a respective class including a respective color of the reserved space (step 812). In some embodiments, upon making a reservation, a user may select a space and in response to selecting the space, the transceiver may send a notification to the user indicate a respective color that the space will be upon arrival of the user. In this regard, upon arrival of the user, the user may easily detect the user's reserved space by detecting the color of the space (e.g., the first color for the first user and/or the second color for the second user). In some embodiments, the user may customize a color or pattern to be displayed only for the respective user upon attending a class. In this regard, in some embodiments, the user may know an associated color or pattern for the user based on the customization instead of receiving a notification.

In some situations, when a class is full (i.e., all of the spots are occupied), a user may join a waitlist. If a participant is not at their reserved spot by the time the class begins (or within a time threshold of when the class begins), users on the waitlist may automatically be assigned to those spots which were not ultimately occupied by those who reserved them. The system may automatically send a notification to the waitlisted user that a spot is now open, and the system may illuminate the now-available spot using the respective lights of the now-available spot. The system may use a color associated with the waitlisted user, or the system may use a unique color not used by any other participant, and may identify the color to the waitlisted user. The system may use one or more sensors to determine whether a spot is being occupied.

Figure 9:
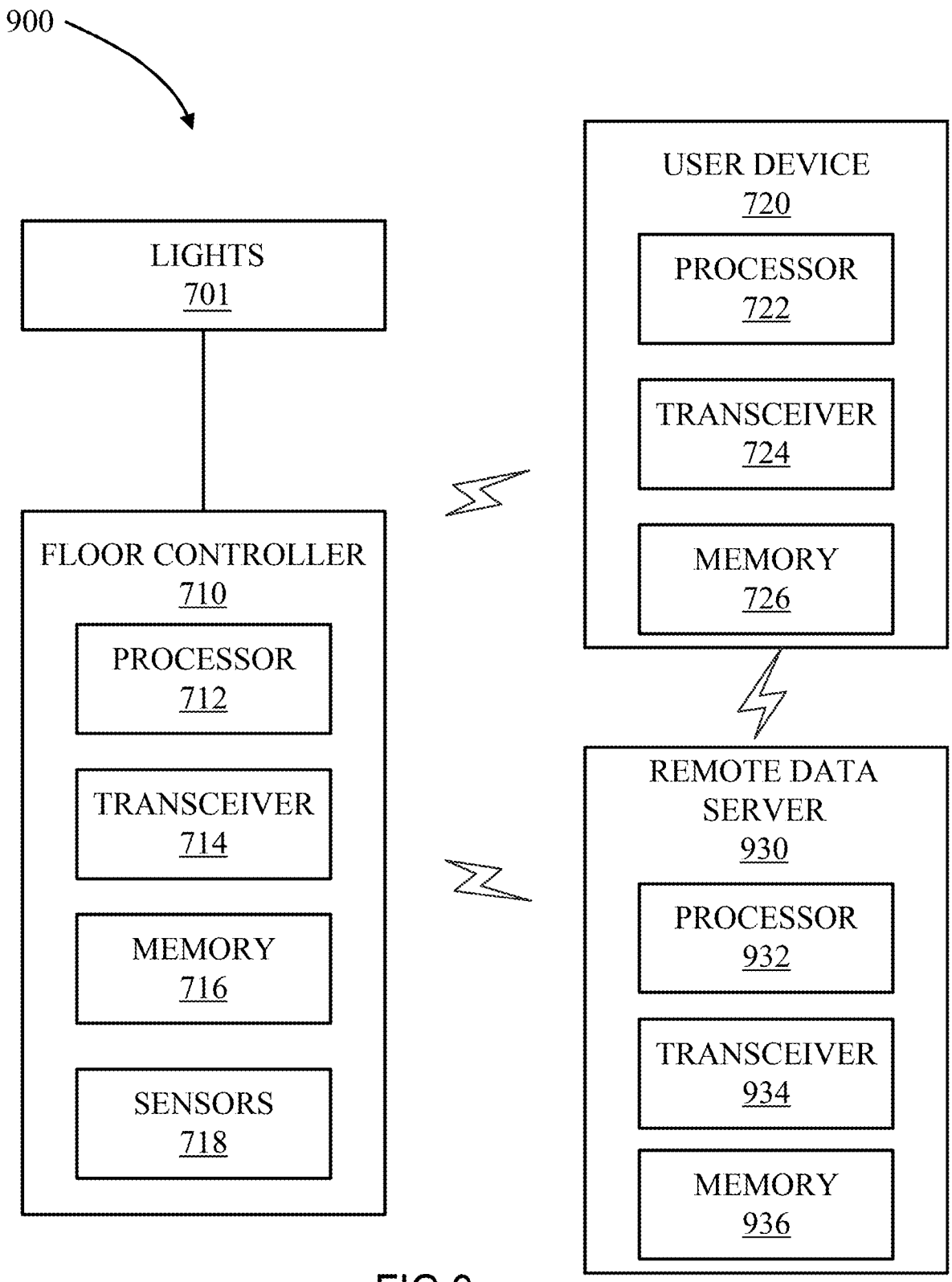
FIG. 9 illustrates a computer-based system of reserving a space, according to various embodiments of the invention.

FIG. 9 illustrates a system 900. The system 900 includes a floor controller 710, a user device 720, a remote data server 930, and lights 701. The remote data server 930 includes a processor 932, a transceiver 934, and a memory 936. The processor 932 may be in accordance with any other processor described herein (e.g., processor 712, processor 722, and/or processor 732). Similarly, the transceiver 934 may be in accordance with any other transceiver described herein, and the memory 936 may be in accordance with any other memory described herein.

The memory 716 is configured to store any data described herein, such as the ambiance data, the floor map data, the body placement data, the music data, the user data, and/or the reservation data received from the remote data server 930 or user device 720 via the transceiver 714.

The floor controller 710 may be coupled to a network. The network, such as a local area network (LAN), a wide area network (WAN), a cellular network, a digital short-range communication (DSRC), LORA (Long Range), the Internet, or any other type of interconnectivity or combinations thereof, connects the floor controller to the remote data server 930 and/or the user device 720.

The transceiver 714 may transmit data to and receive data from devices and systems not physically connected to the floor controller 710. For example, the floor controller 710 may communicate with the remote data server 930. Furthermore, the transceiver 714 may access the network, to which the remote data server 930 is also connected. Multiple remote data servers may be used to increase the memory capacity of the data being stored across the remote data servers, or to increase the computing efficiency of the remote data servers by distributing the computing load across the multiple remote data servers. Multiple remote data servers may be interconnected using any type of network, or the Internet. In some embodiments, components of system 900 and system 700 may be used in any combination thereof.

Figure 10:
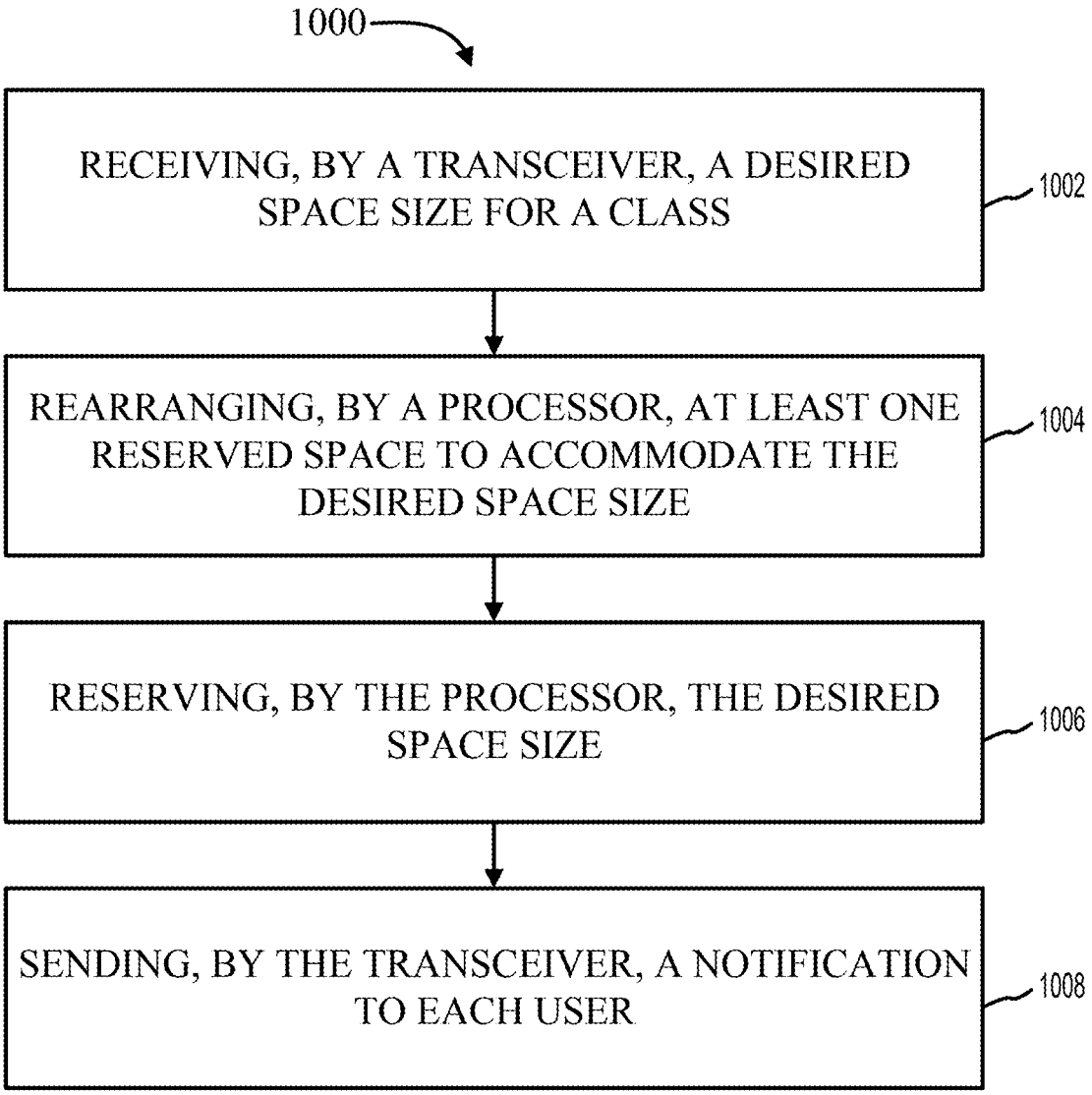
FIG. 10 illustrates a process of the system, according to various embodiments of the invention.

FIG. 10 illustrates a process 1000 performed by the system described herein. The process 1000 is for automatically rearranging spaces for a respective class, such as a yoga class, a strength class, or any other class known in the art.

A transceiver (e.g., a transceiver 714) receives a desired space size for a user for a respective class (step 1002). The transceiver may include a communication port or channel, such as one or more of a Wi-Fi unit, a Bluetooth® unit, a Radio Frequency Identification (RFID) tag or reader, a DSRC unit, a LORA unit, or a cellular network unit for accessing a cellular network (such as 3G, 4G, or 5G) or any other wireless technology. The transceiver may be a component of a floor controller of a yoga studio, or the like. In many embodiments, the desired space size may include an array of cells (e.g., 4 cells×8 cells, or the like). In many embodiments, the desired space size may not be accommodated due to a location of reserved spaces for the respective class.

A processor (e.g., processor 712, processor 722, processor 732, and/or processor 932) rearranges at least one reserved space to accommodate the desired space size (step 1004). In this regard, the processor may automatically determine a rearrangement of the existing reserved spaces in order to accommodate the additional desired space size. In some embodiments, if a desired space size may not be accommodated, a user may receive an error and/or a notification on a user device (e.g., user device 720). The automatic rearrangement may involve an analysis of the occupied spaces to determine whether the currently occupied spaces can be moved, and if they can be moved, whether moving the spaces could result in sufficient space for the additional desired space. The automatic rearrangement may prioritize minimal disruption of existing placements in order to accommodate for the additional space.

The processor reserves the desired space size for the respective user (step 1006). The user may receive a notification indicating the desired space size has been accommodated and/or a newly configured grid indicating a location of the desired space size.

The transceiver may send a notification to each user with a reserved space in the respective class indicating the reserved spaces have been rearranged (step 1008). In some embodiments, only the users with reserved spaces that have been rearranged may receive a notification. The notification may include the newly configured grid indicating a rearranged location of the user's respective reserved space. The notification may be displayed on the user device (e.g., user device 720) of the respective user of the class.

Figure 11:
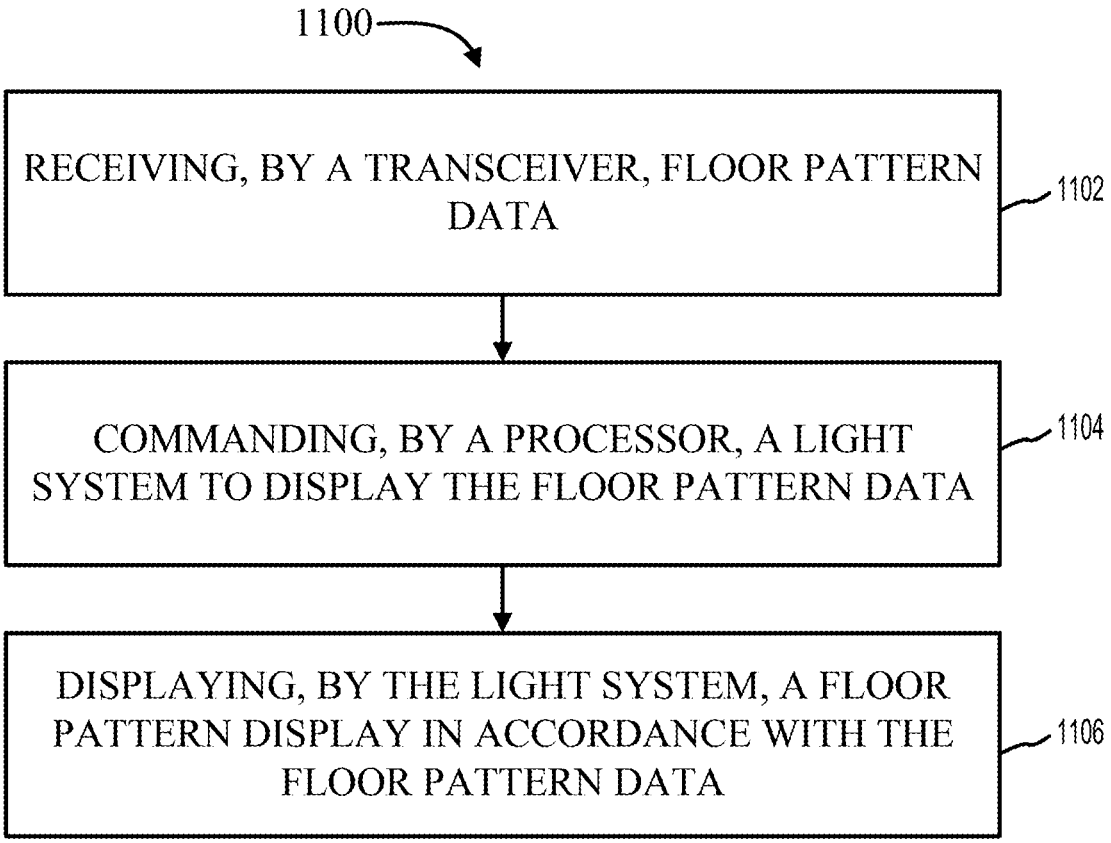
FIG. 11 illustrates a process of the system, according to various embodiments of the invention.

FIG. 11 illustrates a process 1100 performed by the system described herein. The process 1100 is for displaying a floor pattern light display of a light system.

A transceiver (e.g., a transceiver 714) receives floor pattern data from an instructor device (e.g., instructor device 730) (step 1102). The transceiver may include a communication port or channel, such as one or more of a Wi-Fi unit, a Bluetooth® unit, a Radio Frequency Identification (RFID) tag or reader, a DSRC unit, a LORA unit, or a cellular network unit for accessing a cellular network (such as 3G, 4G, or 5G) or any other wireless technology. The transceiver may be a component of a floor controller of a yoga studio, or the like. In many embodiments, the floor pattern data may include a corresponding light floor pattern for lights (e.g., lights 701). In some embodiments, the floor pattern data may include a duration for the floor pattern to be displayed and/or a specific floor pattern to be displayed. In some embodiments, the floor pattern may be displayed until a stop command is received by the transceiver from an instructor device. The floor pattern to be display may be any light pattern, such as a plurality of candles, a field of grass, pulsing lights, varying brightness, waves, or the like.

A processor (e.g., processor 712) commands lights (e.g., lights 701) to display the floor pattern data (step 1104). In this regard, the processor sends a control signal to the light system. In response to receiving the control signal, the light system displays the floor pattern display in accordance with the floor pattern data. The floor pattern data may be a computer-interpretable command of a sequence of instructions for illuminating the lights of the cells of the floor, as described herein.

In some embodiments, the floor pattern display may be displayed for a pre-set duration. In some embodiments, the floor pattern display may be displayed until the light system receives a stop command from the processor. The stop command may be received from the transceiver, which may receive the stop command from an instructor device (e.g., instructor device 730).

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A system for reserving spaces for a class, the system comprising:

a transceiver configured to receive a first reservation data from a first user device indicating a selected space associated with a first participant and a second reservation data from a second user device associated with a second participant; and a processor communicatively coupled to a plurality of lights and configured to:

identify one or more cells of a plurality of cells associated with the selected space associated with the first participant, adjust a color emitted by lights of the identified one or more cells to indicate that the selected space associated with the first participant is reserved, determine that the second participant is not to be accommodated based on previously received reservation data from other participants including the first participant, determine that the second participant is to be accommodated if selected spaces associated with the other participants are adjusted, and automatically adjust locations of one or more spaces of the selected spaces associated with the other participants to accommodate for the second participant.

2. The system of claim 1, wherein the plurality of cells are located along a floor surface, each cell of the plurality of cells having a cavity underneath the floor surface, the cavity housing one or more lights of the plurality of lights.

3. The system of claim 1, further comprising a memory configured to store floor map data including a plurality of virtual cells respectively corresponding to the plurality of cells located along the surface, wherein the processor adjusts the color emitted by lights of the identified one or more cells based on the floor map data.

4. The system of claim 3, wherein the memory is further configured to store class data including space size data associated with the class, the space size data indicating a size of cells corresponding to the selected space associated with the first participant.

5. The system of claim 1, wherein the processor is further configured to instruct one or more cells that are not associated with any participant to emit light of a same color to indicate vacancy.

6. The system of claim 1, wherein the transceiver is further configured to receive user data indicating one or more preferences including at least one of size of the space, shape of the space, or color to be displayed in the space.

7. The system of claim 1, wherein the processor is further configured to instruct the plurality of lights to display a pattern in response to receiving a command from an instructor device.

8. A system for reserving spaces for a class, the system comprising:

a plurality of lights located underneath a floor surface and configured to emit light upward from the floor surface, the floor surface being divided into a plurality of floor cells; and a floor controller electrically coupled to the one or more lights and configured to:

receive a first reservation data for a first space, the first space defined by a first portion of cells of the plurality of floor cells and a second reservation data for a second space, the second space defined by a second portion of cells of the plurality of floor cells;

command one or more lights corresponding to the first portion of cells to emit at least one of a first color or a first pattern;

change the one or more lights corresponding to the first portion of cells and one or more lights corresponding to other cells defining other spaces associated with other reservation data to accommodate for the second space when the second space is not to be accommodated based on the first reservation data and the other reservation data unless the one or more lights corresponding to the first portion of cells and the one or more lights corresponding to the other cells are changed; and command one or more lights corresponding to the second portion of cells to emit at least one of a second color or a second pattern.

9. The system of claim 8, wherein at least one of the first color or the first pattern is customizable by a participant of the class.

10. The system of claim 8, wherein the floor controller is further configured to receive user data associated with the first reservation data.

11. The system of claim 8, wherein the floor controller is further configured to store the first reservation data, the user data, and a floor map data.

12. The system of claim 8, wherein the floor controller commands the one or more lights corresponding to the second portion of cells to emit at least one of the second color or the second pattern proximate to a start time of the class.

13. The system of claim 12, wherein the one or more lights of the first portion of cells emit the first color, wherein the second portion of cells emit the second color, and wherein the first color and the second color are the same.

14. The system of claim 8, further comprising an instructor device in operable communication with the floor controller, the instructor device configured to control a pattern of the one or more lights of each cell of the plurality of cells.

15. A method for dynamically reserving spaces for a class, the method comprising:

receiving, by a transceiver, a first reservation data for the class;

commanding, by a processor, a first space associated with the first reservation data, to emit a first color or a first pattern, the first space defined by a portion of cells of a plurality of cells on a surface;

receiving, by the transceiver, a second reservation data for the class;

determining, by the processor, that a second space associated with the second reservation data is not to be accommodated based on previously received reservation data including the first reservation data;

determining, by the processor, that the second space is to be accommodated if selected spaces associated with the previously received reservation data are adjusted; and automatically adjusting, by the processor, locations of one or more spaces of the selected spaces associated with the previously received reservation data to accommodate for the second space.

16. The method of claim 15, further comprising:

receiving, by the transceiver, a user data corresponding to the first reservation data; and storing, by a memory, the first reservation data and the user data.

17. The method of claim 16, further comprising commanding, by the processor, the second space to emit a second color or a second pattern proximate a reservation time, wherein the second space is available for a participant in the class.

18. The method of claim 15, wherein receiving the first reservation data further comprises receiving a desired space size for the class, and wherein the method further comprises rearranging, by the processor, at least one reserved space to accommodate the desired space size.

* * * * *